US006666113B1

(12) United States Patent
Bravo

(10) Patent No.: US 6,666,113 B1
(45) Date of Patent: Dec. 23, 2003

(54) VALVE WRENCH

(76) Inventor: Gabriel Bravo, P.O. Box 2521, Apple Valley, CA (US) 92307

( * ) Notice: Subject to any disclaimer, the term of this patent is extended or adjusted under 35 U.S.C. 154(b) by 0 days.

(21) Appl. No.: 10/127,554

(22) Filed: Apr. 22, 2002

(51) Int. Cl.[7] ..... B25B 13/48
(52) U.S. Cl. ..... 81/111; 81/116; 81/176.2
(58) Field of Search ..... 81/111, 112, 116, 81/92, 94, 98, 176.1, 176.2, 176.3, 119, 120, 125, 125.1, 186

(56) References Cited

U.S. PATENT DOCUMENTS

| | | | | | |
|---|---|---|---|---|---|
| 221,299 | A | * | 11/1879 | Gray | 411/144 |
| 282,768 | A | * | 8/1883 | Pollard | 81/98 |
| 1,390,408 | A | * | 9/1921 | Webber | 81/125 |
| 1,415,867 | A | * | 5/1922 | Coleman | 81/99 |
| 1,435,111 | A | * | 11/1922 | Fetter | 81/58.5 |
| 1,523,808 | A | * | 1/1925 | Kropacz | 81/145 |
| 1,724,540 | A | * | 8/1929 | Willcox | 81/98 |
| 1,761,988 | A | * | 6/1930 | Layhon | 81/92 |
| 2,659,258 | A | * | 11/1953 | Dillard | 81/125 |
| 2,864,273 | A | * | 12/1958 | Hentosh | 81/124.7 |
| 2,914,979 | A | * | 12/1959 | Weinstein | 81/111 |
| 3,128,656 | A | * | 4/1964 | Draka | 81/98 |
| 3,482,481 | A | | 12/1969 | Newell et al. | |
| 3,599,516 | A | * | 8/1971 | Smedley | 81/56 |
| 3,863,693 | A | * | 2/1975 | Carriker | 81/177.6 |
| 4,084,456 | A | * | 4/1978 | Pasbrig | 81/177.8 |
| 4,750,390 | A | * | 6/1988 | Batten | 81/98 |
| 4,854,198 | A | * | 8/1989 | Batten | 81/98 |
| 5,062,327 | A | | 11/1991 | Hammons et al. | |
| 5,218,891 | A | * | 6/1993 | Olson et al. | 81/125.1 |
| 5,429,018 | A | | 7/1995 | Miller | |
| 5,595,097 | A | * | 1/1997 | Anderson | 81/125.1 |
| 5,865,074 | A | * | 2/1999 | Hsieh | 81/124.3 |

FOREIGN PATENT DOCUMENTS

| | | | | |
|---|---|---|---|---|
| DE | 3136050 A1 | * | 3/1963 | B25B/13/02 |
| DE | 3133481 A1 | * | 3/1983 | B25B/13/32 |

* cited by examiner

*Primary Examiner*—Joseph J. Hail, III
*Assistant Examiner*—David B. Thomas

(57) ABSTRACT

A valve wrench for tightening a male adaptor onto a valve. The valve wrench includes a base member having a pair of opposing ends. Each of the ends of the base member has a bore. The bore of each of the ends extends through the base member whereby the bore of each of the ends is designed for receiving the male adaptor. The base member is designed for being gripped by a hand of the user. Each of the ends of the base member has plurality of angled teeth. The angled teeth inwardly extend from an interior surface of an associated one of the ends of the base member whereby the angled teeth are designed for engaging the male adaptor to preventing slipping of the base member with respect to the male adaptor when the base member is being used to rotate the male adaptor with respect to the valve.

8 Claims, 3 Drawing Sheets

VALVE WRENCH

BACKGROUND OF THE INVENTION

1. Field of the Invention

The present invention relates to tightening wrenches and more particularly pertains to a new valve wrench for tightening a male adaptor onto a valve.

2. Description of the Prior Art

The use of tightening wrenches is known in the prior art. U.S. Pat. No. 3,482,481 describes a device for tightening a nut to a bolt. Another type of tightening wrench is U.S. Pat. No. 5,062,327 having a wrench for tightening a nut securing a yoke of a yoke/universal joint assembly. U.S. Pat. No. 5,429,018 has a wrench providing a low torque ratcheting mode and a high torque non-ratcheting mode for tightening and loosening a fastener.

While these devices fulfill their respective, particular objectives and requirements, the need remains for a device that has certain improved features allowing the wrench to tighten around the male adaptor to ensure a secure fit between the wrench and the male adaptor.

SUMMARY OF THE INVENTION

The present invention meets the needs presented above by providing a lever arm selectively engaging the male adaptor once the male adaptor is positioned in the bore to allow for the male adaptor to be secured in the bore.

Still yet another object of the present invention is to provide a new valve wrench that is able to lock onto the male adaptor to inhibit damage to the male adaptor when the male adaptor is tightened.

To this end, the present invention generally comprises a base member having a pair of opposing ends. Each of the ends of the base member has a bore. The bore of each of the ends extends through the base member whereby the bore of each of the ends is designed for receiving the male adaptor. The base member is designed for being gripped by a hand of the user when the user wishes to rotate the male adaptor with respect to the valve. Each of the ends of the base member has plurality of angled teeth. Each of the angled teeth inwardly extend from an interior surface of an associated one of the ends of the base member whereby the angled teeth are designed for engaging the male adaptor to preventing slipping of the base member with respect to the male adaptor when the base member is being used to rotate the male adaptor with respect to the valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
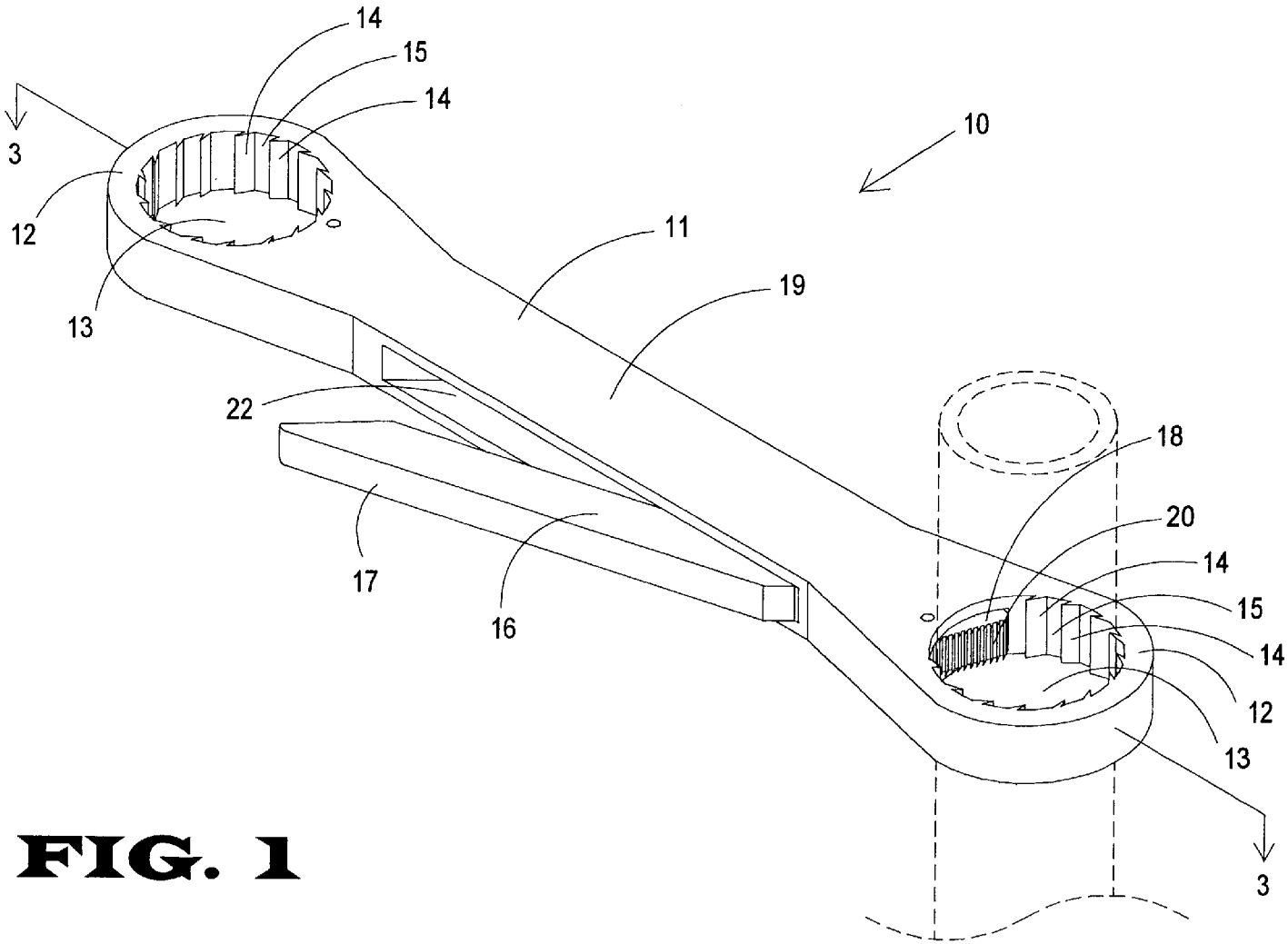
FIG. 1 is a perspective view of a new valve wrench according to the present invention.
Figure 2:
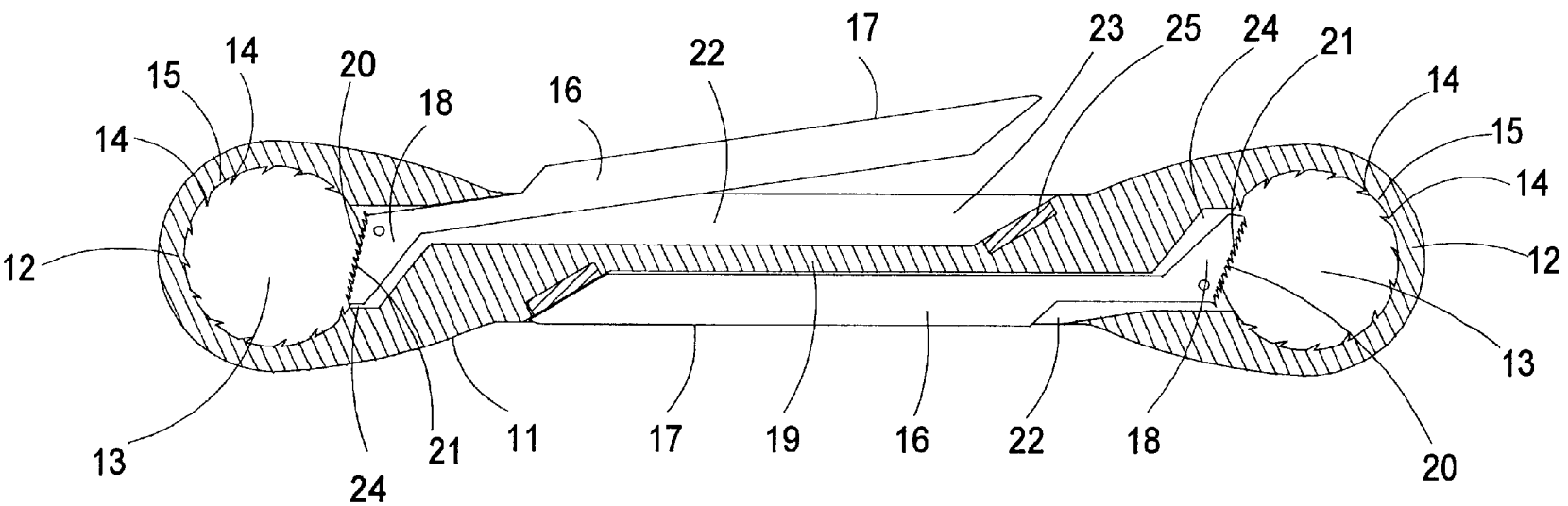
FIG. 2 is a cross-sectional view of the present invention taken along line 2—2.
Figure 3:
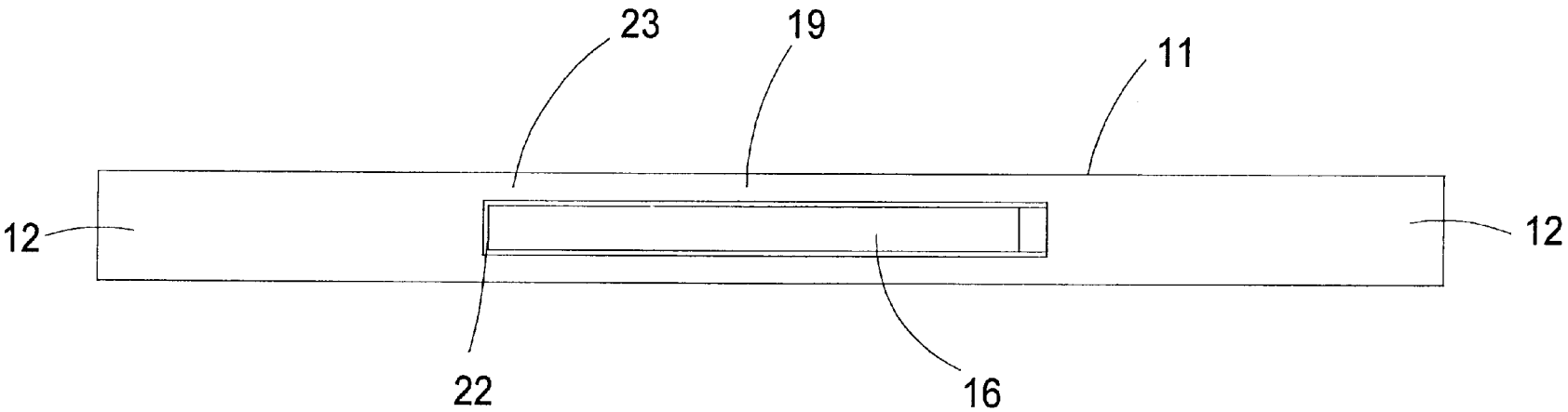
FIG. 3 is a side view of the present invention.

With reference now to the drawings, and in particular to FIGS. 1 through 3 thereof, a new valve wrench embodying the principles and concepts of the present invention and generally designated by the reference numeral 10 will be described.

As best illustrated in FIGS. 1 through 3, the valve wrench 10 generally comprises a base member 11 having a pair of opposing ends 12. Each of the ends 12 of the base member 11 has a bore 13. The bore 13 of each of the ends 12 extends 12 through the base member 11 whereby the bore 13 of each of the ends 12 is designed for receiving the male adaptor. The base member 11 is designed for being gripped by a hand of the user when the user wishes to rotate the male adaptor with respect to the valve. Each of the ends 12 of the base member 11 has plurality of angled teeth 14. Each of the angled teeth 14 inwardly extend from an interior surface 15 of an associated one of the ends 12 of the base member 11 whereby the angled teeth 14 are designed for engaging the male adaptor to preventing slipping of the base member 11 with respect to the male adaptor when the base member 11 is being used to rotate the male adaptor with respect to the valve. The bore 13 of one of the ends 12 may have a diameter of an inch and the bore 13 of the other of the ends 12 may have diameter of ¾ an inch. The angling of the angled teeth 14 allows the angled teeth 14 to grip into the male adaptor and turn the male adaptor when the base member 11 is rotated in first direction and yet allow the angled teeth 14 to slide across the male adaptor when the base member 11 is rotated in the other direction.

A pair of lever arms 16 are pivotally coupled to the base member 11. Each of the lever arms 16 is in communication with the bore 13 of one of the ends 12 of the base member 11. The lever arm decreases the diameter of the bore 13 of the associated one of the ends 12 of the base member 11 for engaging the male adaptor to secure the male adaptor when the male adaptor is rotated.

Each of the lever arms 16 has a hand portion 17 and an engagement portion 18. The hand portion 17 extends 12 along a medial portion 19 of the base member 11. The engagement portion 18 is positioned adjacent the bore 13 of an associated one of the ends 12 of the base member 11 whereby the engagement portion 18 is extendable into the bore 13 when hand portion 17 is substantially aligned with the medial portion 19 of the base member 11. The engagement portion 18 is designed for engaging the male adaptor when the hand portion 17 is aligned with the medial portion 19 of base member 11.

The engagement portion 18 of each of the lever arms 16 has engagement teeth 20. The engagement teeth 20 are positioned on an engagement face 21 of the engagement portion 18 of the associated one of the lever arms 16. The engagement teeth 20 are designed for engaging the male adaptor for inhibiting slipping of the male adaptor with respect to the base member 11 when the male adaptor is being rotated.

The medial portion 19 of the base member 11 has a pair of channels 22. Each of the lever arms 16 is positioned in one of the channels 22 of the base member 11. Each of the channels 22 is in communication with the bore 13 of the associated one of the ends 12 whereby the associated one of the lever arms 16 is pivotal into the bore 13 of the associated one of the ends 12.

Each of the channels 22 of the base member 11 has an arm portion 23 and a recessed portion 24. The arm portion 23 selectively receives the hand portion 17 of the associated one of the lever arms 16 when the engagement portion 18 of the associated one of the lever arms 16 extends 12 into the bore 13 of the associated one of the ends 12. The recessed portion 24 is for receiving the engagement portion 18 of the associated one of the lever arms 16 when the engagement portion 18 is retracted from the bore 13 of the associated one of the ends 12.

The base member 11 has a pair retaining portions 25. Each of the retaining portions 25 is positioned adjacent one of the channels 22 of the base member 11. Each of the retaining portions 25 is for retaining the lever arms 16 in the associated one of the channels 22 when the base member 11 is not in use.

Each of the retaining portions 25 of the base member 11 comprises a magnet. The magnet is for magnetically attracting the hand portion 17 of the associated one of the lever arms 16 when the hand portion 17 of the associated one of the lever arms 16 is positioned in the arm portion 23 of the associated one of the channels 22 of the base member 11.

In use, the user pushes the engagement member into the recessed portion 24 of the associated one of the channels 22 to pivot the hand portion 17 of the associated one of the lever arms 16 away from the base member 11. The male adaptor is then extended through the more appropriately sized bore 13 of the base member 11. The user then squeezes the hand portion 17 extended away from the base member 11 towards the base member 11 to bring the engagement portion 18 into contact with the male adaptor and secure the male adaptor in the bore 13. The base member 11 is then rotated so as to tighten the male adaptor to the valve. The engagement portion 18 of the associated one of the lever arms 16 is the pressed against the male adapted to force the engagement portion 18 into the recessed portion 24 to allow the base member 11 to be removed from the male adaptor.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A valve wrench for tightening a male adaptor onto a valve, the valve wrench comprising:

a base member having a pair of opposing ends, each of said ends of said base member having a bore, said bore of each of said ends extending through said base member such that said bore of each of said ends is adapted for receiving the male adaptor, said base member being adapted for being gripped by a hand of the user when the user wishes to rotate the male adaptor with respect to the valve, each of said ends of said base member having plurality of angled teeth, each of said angled teeth inwardly extending into an associated one of said bores from an interior surface of an associated one of said ends of said base member such that said angled teeth are adapted for engaging the male adaptor to prevent slipping of said base member with respect to the male adaptor when the base member is being used to rotate the male adaptor with respect to the valve; and a pair of lever arms being pivotally coupled to said base member, each of said lever arms being in communication with said bore of one of said ends of said base member, said lever arm decreasing the diameter of said bore of the associated one of said ends of said base member for engaging the male adaptor to secure the male adaptor when the male adaptor is rotated.

2. The valve wrench as set forth in claim 1, further comprising:

each of said lever arms having a hand portion and an engagement portion, said hand portion extending along a medial portion of said base member, said engagement portion being positioned adjacent said bore of an associated one of said ends of said base member such that said engagement portion is extendable into said bore when hand portion is substantially aligned with said medial portion of said base member, said engagement portion being adapted for engaging the male adaptor when the hand portion is aligned with the medial portion of base member.

3. The valve wrench as set forth in claim 2, further comprising:

said engagement portion of each of said lever arms having engagement teeth, said engagement teeth being positioned on an engagement face of said engagement portion of the associated one of said lever arms, said engagement teeth being adapted for engaging the male adaptor for inhibiting slipping of the male adaptor with respect to the base member when the male adaptor is being rotated.

4. The valve wrench as set forth in claim 2, further comprising:

said medial portion of said base member having a pair of channels, each of said lever arms being positioned in one of said channels of said base member, each of said channels being in communication with said bore of the associated one of said ends such that the associated one of said lever arms is pivotal into said bore of the associated one of said ends.

5. The valve wrench as set forth in claim 4, further comprising:

each of said channels of said base member having an arm portion and a recessed portion, said arm portion selectively receiving said hand portion of the associated one of said lever arms when said engagement portion of the associated one of said lever arms extends into said bore of the associated one of said ends, said recessed portion being for receiving said engagement portion of the associated one of said lever arms when said engagement portion is retracted from said bore of the associated one of said ends.

6. The valve wrench as set forth in claim 4, further comprising:

said base member having a pair retaining portions, each of said retaining portions being positioned adjacent one of said channels of said base member, each of said retaining portions being for retaining said lever arms in the associated one of said channels when said base member is not in use.

7. The valve wrench as set forth in claim 6, further comprising:

each of said retaining portions of said base member comprising a magnet, said magnet being for magnetically attracting said hand portion of the associated one of said lever arms when said hand portion of the associated one of said lever arms is positioned in said arm portion of the associated one of said channels of said base member.

8. A valve wrench for tightening a male adaptor onto a valve, the valve wrench comprising:

a base member having a pair of opposing ends, each of said ends of said base member having a bore, said bore of each of said ends extending through said base member such that said bore of each of said ends is adapted for receiving the male adaptor, said base member being adapted for being gripped by a hand of the user when the user wishes to rotate the male adaptor with respect to the valve, each of said ends of said base member having plurality of angled teeth, each of said angled teeth inwardly extending into an associated one of said bores from an interior surface of an associated one of said ends of said base member such that said angled teeth are adapted for engaging the male adaptor to prevent slipping of said base member with respect to the male adaptor when the base member is being used to rotate the male adaptor with respect to the valve;

a pair of lever arms being pivotally coupled to said base member, each of said lever arms being in communication with said bore of one of said ends of said base member, said lever arm decreasing the diameter of said bore of the associated one of said ends of said base member for engaging the male adaptor to secure the male adaptor when the male adaptor is rotated;

each of said lever arms having a hand portion and an engagement portion, said hand portion extending along a medial portion of said base member, said engagement portion being positioned adjacent said bore of an associated one of said ends of said base member such that said engagement portion is extendable into said bore when hand portion is substantially aligned with said medial portion of said base member, said engagement portion being adapted for engaging the male adaptor when the hand portion is aligned with the medial portion of base member;

said engagement portion of each of said lever arms having engagement teeth, said engagement teeth being positioned on an engagement face of said engagement portion of the associated one of said lever arms, said engagement teeth being adapted for engaging the male adaptor for inhibiting slipping of the male adaptor with respect to the base member when the male adaptor is being rotated;

said medial portion of said base member having a pair of channels, each of said lever arms being positioned in one of said channels of said base member, each of said channels being in communication with said bore of the associated one of said ends such that the associated one of said lever arms is pivotal into said bore of the associated one of said ends;

each of said channels of said base member having an arm portion and a recessed portion, said arm portion selectively receiving said hand portion of the associated one of said lever arms when said engagement portion of the associated one of said lever arms extends into said bore of the associated one of said ends, said recessed portion being for receiving said engagement portion of the associated one of said lever arms when said engagement portion is retracted from said bore of the associated one of said ends;

said base member having a pair retaining portions, each of said retaining portions being positioned adjacent one of said channels of said base member, each of said retaining portions being for retaining said lever arms in the associated one of said channels when said base member is not in use; and each of said retaining portions of said base member comprising a magnet, said magnet being for magnetically attracting said hand portion of the associated one of said lever arms when said hand portion of the associated one of said lever arms is positioned in said arm portion of the associated one of said channels of said base member.

* * * * *